US011419392B2

(12) United States Patent
Galindo et al.

(10) Patent No.: US 11,419,392 B2
(45) Date of Patent: Aug. 23, 2022

(54) CLASP ASSEMBLY

(71) Applicant: Precision Dynamics Corporation, Valencia, CA (US)

(72) Inventors: Haroldo Chavez Galindo, Baja California (MX); Madeline Boulier, Valenda, CA (US); Jeffrey Nguyen, Tracy, CA (US); Steven Marks, Valencia, CA (US)

(73) Assignee: Precision Dynamics Corporation, Valencia, CA (US)

( * ) Notice: Subject to any disclaimer, the term of this patent is extended or adjusted under 35 U.S.C. 154(b) by 0 days.

(21) Appl. No.: 16/868,156

(22) Filed: May 6, 2020

(65) Prior Publication Data

US 2020/0352286 A1 Nov. 12, 2020

Related U.S. Application Data

(60) Provisional application No. 62/844,264, filed on May 7, 2019.

(51) Int. Cl.

| | |
|---|---|
| ***A44B 17/00*** | (2006.01) |
| ***A44B 11/25*** | (2006.01) |
| ***A44C 5/18*** | (2006.01) |

(52) U.S. Cl.

CPC ..... *A44B 11/258* (2013.01); *A44C 5/18* (2013.01)

(58) Field of Classification Search

CPC ..... A44B 5/00; A44B 1/34; A44B 11/258; A44C 5/18

See application file for complete search history.

(56) References Cited

U.S. PATENT DOCUMENTS

| | | | | |
|---|---|---|---|---|
| 424,795 | A | 4/1890 | Kraetzer | |
| 2,163,016 | A * | 6/1939 | Barker | A01K 35/00 29/512 |
| 2,235,168 | A * | 3/1941 | Reiter | A44B 17/0011 24/680 |
| 3,141,321 | A * | 7/1964 | Rinaldi | A44B 15/00 70/459 |
| 3,416,200 | A | 12/1968 | Daddona | |
| 4,161,806 | A * | 7/1979 | Hennisse | A41F 1/006 24/594.11 |
| 4,272,869 | A * | 6/1981 | Willner | A44B 5/00 24/3.12 |
| 4,606,097 | A * | 8/1986 | Lam | A44B 1/34 24/102 R |
| 4,819,309 | A * | 4/1989 | Behymer | F16B 3/00 24/DIG. 39 |

(Continued)

FOREIGN PATENT DOCUMENTS

WO 2018060908 A1 4/2018

OTHER PUBLICATIONS

International Searching Authority. International Search Report and Written Opinion for application PCT/US2020/031619. dated Oct. 6, 2020. 11 pages.

*Primary Examiner* — Jason W San

(74) *Attorney, Agent, or Firm* — Quarles & Brady LLP

(57) ABSTRACT

A clasp assembly includes a pair of identical half sections configured to be coupled to one another. Each half section comprises one or more deformable features that are designed to deform during closure to create an interlocking engagement between each half section.

18 Claims, 5 Drawing Sheets

(56) References Cited

U.S. PATENT DOCUMENTS

| | | | | |
|---|---|---|---|---|
| 4,913,174 | A * | 4/1990 | Cusenza | A45D 8/00 132/261 |
| 4,982,480 | A * | 1/1991 | Kasai | A44B 17/0029 24/DIG. 38 |
| 5,224,247 | A * | 7/1993 | Collier | A44B 11/28 24/DIG. 42 |
| 6,598,271 | B2 * | 7/2003 | Nire | A44B 11/258 24/303 |
| 7,240,446 | B2 | 7/2007 | Bekker | |
| 8,490,257 | B2 * | 7/2013 | Cameron | A44B 1/14 24/114.9 |
| 10,111,500 | B2 * | 10/2018 | Lambert | A44B 11/28 |
| 2002/0029444 | A1 * | 3/2002 | Lyle | A44B 17/0029 24/621 |
| 2002/0116794 | A1 * | 8/2002 | Hoffman | A44B 5/00 24/584.1 |
| 2003/0005558 | A1 * | 1/2003 | Wong | A41F 1/006 24/303 |
| 2006/0010658 | A1 | 1/2006 | Bigley | |
| 2012/0124791 | A1 | 5/2012 | Hasegawa | |
| 2021/0106100 | A1 * | 4/2021 | Marrone | A44B 5/02 |

* cited by examiner

CLASP ASSEMBLY

CROSS-REFERENCE TO RELATED APPLICATION

This application claims the benefit of U.S. Provisional Patent Application No. 62/844,264 entitled "Clasp Assembly" filed on May 7, 2019, the entire contents of which are incorporated herein by reference.

FIELD OF INVENTION

This disclosure relates to a clasp assembly such as could be used, for example, in a wristband.

BACKGROUND

Wristbands are used in a variety of situations. For example, wristbands can be used at events to authorize, locate, and/or identify participants at the event. Additionally, wristbands are ubiquitous in medical facilities as an identification and tracking device for patients undergoing medical care.

Most wristbands include a securing feature such as an adhesive section or a clasp and, after a loop has been formed, the securing feature keeps the wristband around the person wearing it. Such securing features can be used to adjust the length of the wristband to accommodate different tethering conditions (for example, for attachment to a large adult wrist versus a small child wrist) and, in many cases, to create a non-reversible connection to prevent non-destructive removal of the band, which also renders the identification device tamper-proof.

Clasps are extremely valuable as securing features as they enable the comfortable wearing using pre-indexed positions that are easy to install. Adhesive, by contrast, is less expensive to manufacture, but requires some placement skill to align and can lead to exposed adhesive that sticks to skin or hair and can make wearing uncomfortable and removal painful.

One complicating factor for the design of clasps is their assembly and insertion into wristband forms. This is done out of convenience and simplicity, but adds to the expense of manufacturing as nearly all clasps have a male and female or stud and socket type design. These two separate articles require separate sets of tooling for molds and insertion and often need to be carefully sorted during the manufacturing process.

SUMMARY

An improved and novel clasp assembly with interlocking engagement is disclosed herein for a wristband that is formable into a loop. The clasp assembly can aid in keeping the wristband in a constant loop around the person wearing the wristband, can be simple in construction, and can prohibit non-destructive removal.

Of particular advantage is that the clasp assembly is designed to have two identical half sections instead of, for example, a male and female section or otherwise differentiated half sections. By having identical half sections, only a single type of half section needs to be produced for the clasp assembly instead of two unique half sections. This can save production costs by not requiring two sets of tooling for injection molding of the clasp portions. Still further, any possibility of mistake during the assembly of the half sections to a wristband can be avoided since, without unique half sections, there is no requirement that exactly one of each type of half section for the clasp assembly needs to be installed in a single wristband.

According to one aspect, a clasp assembly is provided which includes a pair of identical half sections configured to be coupled together. Each half section may include one or more deformable features that are designed to deform during closure to create an interlocking engagement between each half section.

In some forms, after interlocking engagement, the pair of identical half sections may not be completely axially separable without permanent mechanical destruction of the one or more deformable features.

In some forms, the clasp assembly may have interlocking projections with teeth. In such forms, the pair of identical half sections may include a base and the one or more deformable features may be a plurality of posts extending axially from the base. Each of the posts of the identical half sections may have a distal end away from the base including a tooth that radially projects from the post in which the tooth include a stop surface facing the base. The teeth of the posts may have a wedge-like shape. The teeth may further include tapered surfaces on angular ends thereof that narrow as the teeth extend towards the distal end of the respective post. In such a design, when the posts of the pair of half sections are axially brought together to engage the teeth of the posts together, the tapered surfaces on angular ends of the posts on each of the half sections may contact one another and effectuate the elastic deformation of the posts to permit the teeth of the posts to pass by one another until the stop surfaces of one of the half sections has axially passed the stop surfaces of the other one of the half sections, and the posts return to a non-deformed state which thereby creates an interlocking engagement between the posts on each of the half sections at the stop surfaces. It is contemplated that, in this form, each of the stop surfaces may have a corresponding angular extent between angular ends of the respective stop surface and the total summed amount of the angular extents of all of the plurality of stop surfaces on one of the half sections may exceed 180 degrees. This creates assured angular overlap between the stop surfaces of the pair of half sections with one another when the posts of the half sections are brought together in interlocking engagement.

In some forms, an alternative toothed structure is provided in which the base may include cutouts in which the teeth of the other half section are received. As with the first type of toothed structure, the pair of identical half sections may include a base and the one or more deformable features may be a plurality of posts extending axially from the base. In this form instead of teeth engaging with other teeth, the base can include a plurality of cutouts spaced about a peripheral edge of the base and, when the pair of half sections are axially brought together, the plurality of posts may elastically deform over a distance of axial travel during joining until the plurality of posts snap back to engage the plurality of cutouts on the periphery of the base and restrict axial separation of the pair of half sections. The plurality of posts may elastically deform outward due to an engagement of an axially-inclined surface of each respective post on one of the pair of half sections with the base (or an edge or surface thereof) on the other of the pair of half sections. Each of the posts may include a stop surface facing the base of the half section to which the posts belong and, when the pair of half sections are axially brought together to cause engagement of the plurality of posts with the plurality of cutouts, each stop surface engages an oppositely facing surface of a corresponding cutout to restrict the axial separation of the pair of half sections.

In still yet another form, the deformable features may have include various segments with frustospherical concave and convex portions that can be joined together reminiscent of a ball and socket type joint. Again, the pair of identical half sections may include a base with the one or more deformable features being a plurality of posts extending axially from the base. At least one of the plurality of posts may include an axially-facing concave surface (that is, axially-facing in that it faces in a radial direction facing the central axis as opposed to away from the axis) and at least one of the plurality of posts may include an outwardly-facing convex surface. The axially-facing concave surfaces are configured for interlocking engagement with the outwardly-facing convex surfaces when the pair of half sections are axially brought together. The axially-facing concave surfaces and the outwardly-facing convex surfaces may be, for example, frustospherical surfaces or elongated versions thereof. The number of the axially-facing concave surfaces may match the number of the outwardly-facing convex surfaces. In such forms, when the plurality of posts of the pair of half sections are axially brought together to engage the outwardly-facing convex surfaces of the posts with the axially-facing concave surfaces of the posts, the outwardly-facing convex surfaces of the posts on each of the half sections may contact the axially-facing concave surfaces of the posts and effectuate the elastic deformation of the posts to permit the outwardly-facing convex surfaces of the posts to pass by the distal ends of the posts having the axially-facing concave surfaces until the outwardly-facing convex surfaces reach or approach the proximal end of the axially-facing concave surface. Once there, the posts may return to a non-deformed state to create an interlocking engagement between the posts on one of the half sections at the outwardly-facing convex surfaces and the axially-facing concave surface of the posts on the other one of the half sections.

In still other forms, yet another mechanical type of interlock is provided in which balls or heads on the end of posts are plugged into corresponding depressions on the opposing base. Again, the pair of identical half sections may include a base with the one or more deformable features being a plurality of posts extending axially from the base. At least one of the plurality of posts may have a ball-shaped surface and the base may further comprises a plurality of socket depressions that are configured to interlock with the ball shaped surfaces of the posts. The number of the ball-shaped surfaces may match the number of socket depressions. When the plurality of posts of the pair of half sections are axially brought together to engage the ball-shaped surfaces of the posts with the socket depressions, the ball-shaped surfaces of the posts on each of the half sections may contact with the socket depressions and effectuate the elastic deformation to seat the ball-shaped surfaces of the posts in the socket depressions thereby creating an interlocking engagement between the posts on one of the half sections at the ball-shaped surface and the socket depressions on the base of the other half section.

In some forms, the pair of half sections may each be an integrally formed plastic component.

According to another aspect, a wristband is provided including any of the aforementioned clasp assemblies described above or herein. In some forms, the wristband can include a band formable into a loop including the clasp assembly of the types described above and herein. It is also contemplated that this clasp assembly could also be used in other products (i.e., other than wristbands) in which non-reversible clasp attachment is desired.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1:
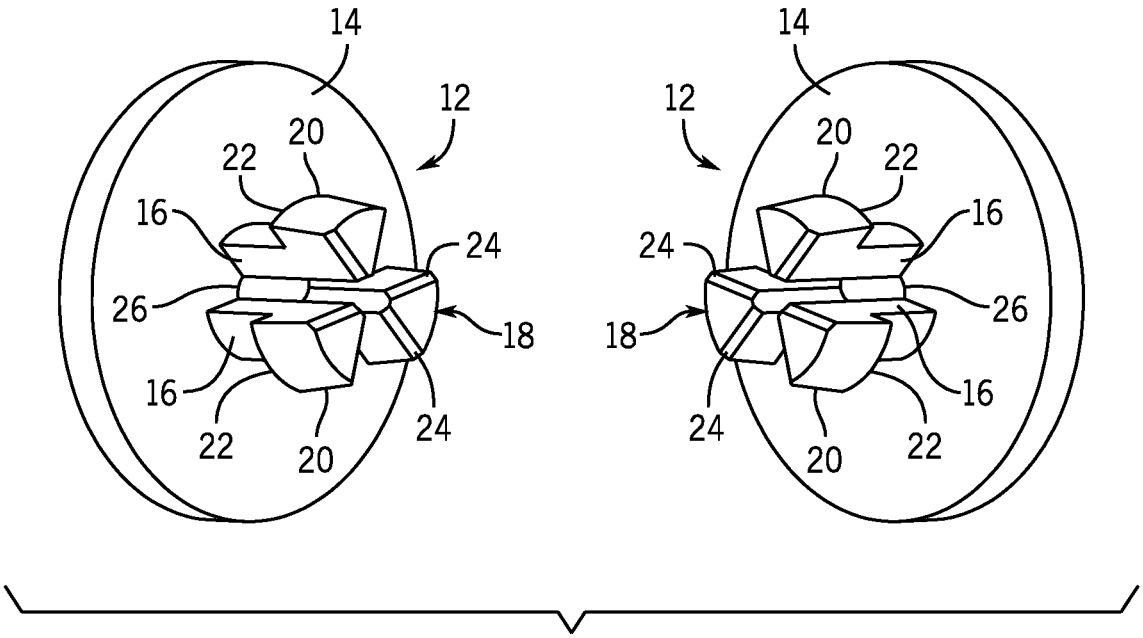
FIG. 1 is an exploded top, front, side perspective view of a pair of identical half sections of an exemplary "engaged teeth" clasp assembly according to one embodiment. In this embodiment, each identical half section includes three protruding posts having teeth on the distal ends of the posts that are engageable with the teeth on the posts of the other mating half section.

Before any embodiments of the invention are explained in detail, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Some of the discussion below describes a clasp assembly with an interlocking arrangement for a band that is formable into a loop and secured by the clasp assembly. While the discussion herein primarily discusses wristbands, the context and particulars of this discussion are presented as examples only and other embodiments are contemplated as falling within the scope of this disclosure. For example, embodiments of the disclosed clasp assemblies can include a variety of applications apart from those specifically illustrated with respect to wrist bands including but not limited to ankle bands (such as for infants), medical bands, bands for events such as concerts, straps for attachment around an object, and so forth. Still further, embodiments of the disclosed invention can be constructed from a variety of differently-shaped components that are assembled in various configurations including by use of different numbers of mating features than those depicted, only some of which embodiment will be described herein.

As used herein, the terms "deform" and "deformable" refer to any distortion of shape or form from an initial shape or form of a component. Such distortion may be temporary in nature (as in elastic deformation) or permanent in nature (as in plastic deformation). It is contemplated that, when a component is described as being "deformed" to create engagement between clasp sections herein, that that such deformation could involve a change from an initial un-deformed state to a deformed state. Depending on the design and mode of clasp operation, the component could remain in that deformed state to create engagement or could involve a subsequent return from that deformed state back towards or to its initial un-deformed state with such return being in full or only in part to create engagement.

Looking first at FIG. 1, FIG. 1 illustrates an exploded view of an exemplary "toothed engagement" style clasp assembly 10 according to one embodiment. The clasp assembly 10 is designed to be affixed to a wristband, allowing the wristband to be formed into to loop around the wrist of the person wearing the wristband using the clasp assembly 10. Such a wristband—albeit without the newly disclosed clasp assembly—can be found, for example, in U.S. Pat. No. 7,240,446 to Precision Dynamics Corporation which issued on Jul. 7, 2007 which is incorporated by reference for all purposes as if set forth in its entirety herein.

The clasp assembly 10 includes a pair of half sections 12 that, as illustrated, are identical to one another. Each half section 12 can be an integrally formed unitary structure, for example, formed by plastic injection molding. By being formed from plastic, thin walls of the parts—such as the posts 16 that will be described in greater detail below—may be elastically deformable or able to temporarily bend or deflect.

Each of the pair of half sections 12 includes a base 14, which as illustrated can be generally disc-shaped. However, the base 14 can be in various other forms or shapes. For example, the base 14 could be rectangular, square, triangular or other polygonal or non-polygonal shape. The shape of the base 14 may be altered in some cases, based on the shape of the wristband to which the clasp assembly 10 is attached.

The base 14 has a plurality of posts 16 extending from the base 14 in a generally axial direction relative to the disc that forms the base 14. These posts 16 are angularly positioned about the center of the base 14. As illustrated, there are three posts 16 on each respective base 14; however, it is contemplated that there could be two, three, or more posts on each base 14 and a similar operational effect could be achieved to that which is described herein.

Each of the posts 16 have a distal end 18 away from the base 14, which includes a tooth 20 (collectively, teeth). Each tooth 20 has a wedge-like shape and radially projects from the respective post 16. As illustrated, this projection is radially outwardly relative to the central axis. As part of this projecting shape, each tooth 20 has a stop surface 22 facing back towards the base 14 from which the posts 16 extend. Each tooth 20 also includes tapered surfaces 24 on angular ends of the respective tooth 20, which narrow the teeth 20 towards the distal ends 18 of the posts 16. As illustrated, the tapered surfaces 24 include two sections, a bevel that is approximately 45 degrees angled relative to the central axis near the distal end 18 and an inclined section that runs from the end of the bevel to the axial position of the stop surface 22. While illustrated as flat surfaces, the tapered surfaces 24 could also include some amount of curvature and the illustrated shapes are exemplary but not limiting.

While a particular shape and size of the posts 16 and teeth 20 have been shown, one of ordinary skill in the art will appreciate certain variations may be made while maintaining the functionality described below. For example, the teeth do not need to be triangular wedge shaped, but might be longer arcs. Still further, while the stop surfaces of the teeth are illustrated on the radially outward side of the posts, it is contemplated that differently structure posts and teeth could present these stop surfaces on the radially inward facing side of the posts instead.

As illustrated, each of the half sections 12 can further include a center support 26 located between the plurality of posts 16. In the form presented, the center support 26 is cylindrically shaped and located at the center of each of the half sections 12. This center support 26 can be connected to each of the posts 16 for a portion of their axial length to improve or control rigidity of the posts 16. The center support 26 need not be cylindrical (or even present at all in many designs) and could be in the shape of pillar or rectangular prism. However, when present, the center supports 26 may also provide another stop surface (provided by axial face of the center supports 26, which may be flat) when the half sections 12 are joined, in addition to the stop surfaces 22, that prevents over-insertion of the two half sections together.

Figure 2:
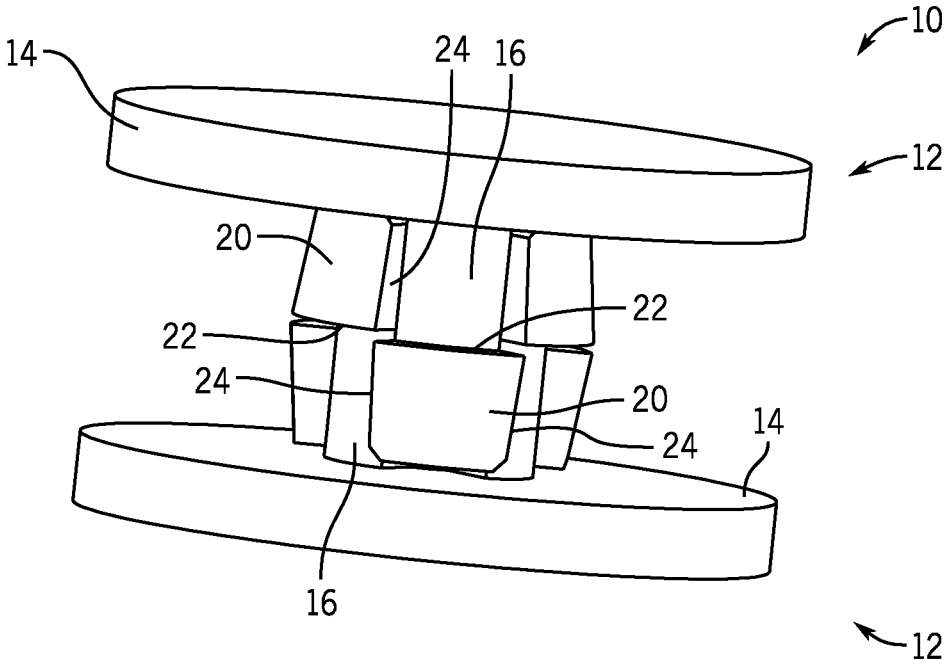
FIG. 2 is a perspective view of the clasp assembly of FIG. 1 in an assembled state in which the two identical half sections of FIG. 1 have been axially brought together to create an interlocking engagement by the teeth to close the clasp.

Looking now specifically at FIG. 2, FIG. 2 illustrates the clasp assembly 10 of FIG. 1 in an assembled state in which the pair of half sections 12 of the clasp assembly 10 are secured to one another. Specifically, to lock or engage the sections 12 together, the plurality of posts 16 of the pair of half sections 12 are axially brought together to engage the teeth 20 of the posts 16 together. The teeth 20 of one of the sections 12 are drawn into the space between the teeth 20 on the other one of the sections 20 and the tapered surfaces 24 on angular ends of the posts 16 on each of the half sections 12 contact one another. This contact between the half sections 12 effectuates the elastic deformation of the posts 16 to permit the teeth 20 of the posts 16 to pass by one another until the stop surface 22 of one of the half sections 12 axially passes the stop surface 22 of the other half section 12. The posts 16 then deflect back or return to a non-deformed state creating an interlocking engagement between the posts 16 on each of the half sections 12 at the stop surfaces 22 as illustrated in FIG. 2.

It can be observed that, for the posts 16 of the half sections 12 to be in assuredly interlocking engagement, a total angular extent of the stop surfaces 22 on each of the pair of half sections 12 could be made to exceed 180 degrees. By this, it is meant that each of the respective stop surfaces 22 can have an angular extent that is measured between the pair of angular ends of that particular stop surface 22 (as measured about a central axis) and that, when all of the angular extents of all the stop surfaces 22 on one of the half sections 12 are added together, this summed total exceeds 180 degrees. For example, in the illustrated embodiment, each of the three stop surfaces 22 may have approximately 65 degrees of angular extent, which collectively sum to approximately 195 degrees. While not an absolute requirement, this amount of angular extent necessarily creates some amount of angular overlap in joined identical half sections. Similarly, such a total summed angular extent creates some amount of overlap of the tapered surfaces 24 so the tapers almost certainly will result in less than 180 degrees of cumulative angular extent on the distalmost end of the posts 16, which will permit these distal ends to interact together during the axial insertion of the sections 12 together to create the temporary mechanical displacement of the posts 16 and the teeth 20. It will of course be appreciated that, depending on the particularly geometric form and arrangement of teeth, the stop surfaces could have less than 180 degrees of extent and the primary consideration is whether the particular geometry employed readily permits one-way engagement of the teeth without the ability to separate the halves once joined.

In the form illustrated, the interlocking engagement of the teeth 20 at the stop surfaces 22 prevents the half sections 12 from separating absent mechanical destruction of at least some of the teeth or post structure. A tensile pull along an axial direction opposite the assembly direction would not pull the two half sections 12 apart without destroying the teeth 20 because of the non-reversible connection at the stop surfaces 22. Destroying the teeth 20 would also destroy the clasp assembly 10 and prevent the wristband from staying on the person. Accordingly, the clasp assembly 10 provides a non-reversible, secure mechanism for one time-attachment that is O-tamper proof.

Figure 4:
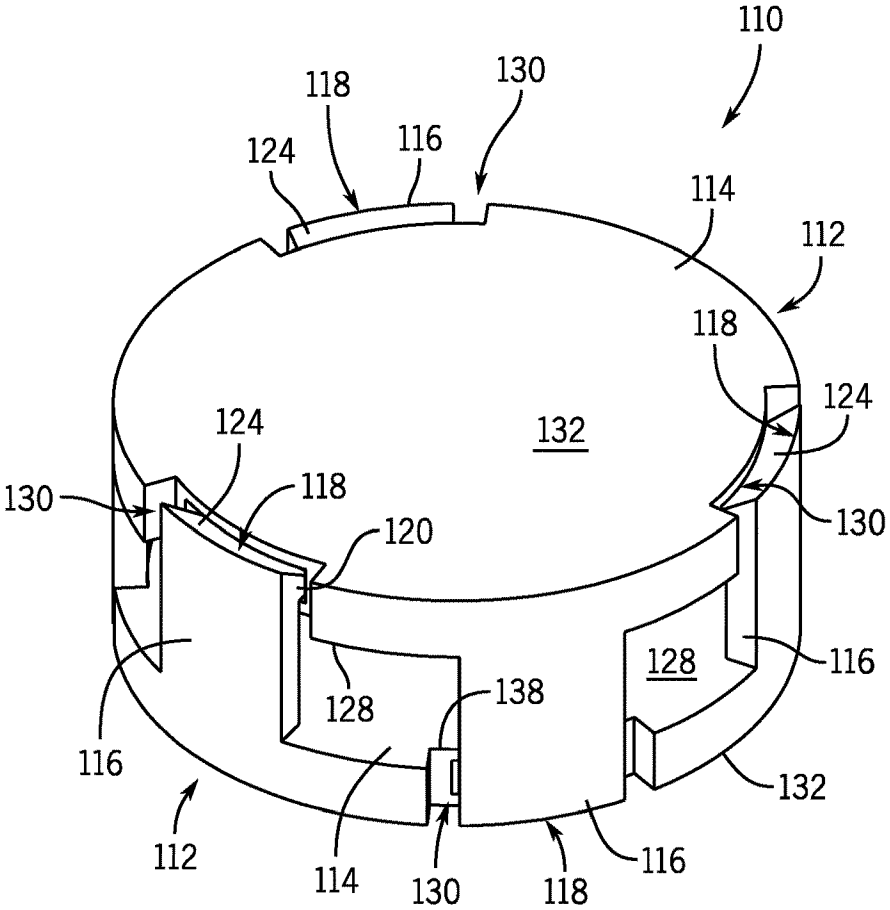
FIG. 4 is a perspective view of a clasp assembly assembled from two identical half sections of the kind shown in FIG. 3 in which the two half sections have been axially brought together to create an interlocking engagement between the teeth and cutouts.
Figure 3:
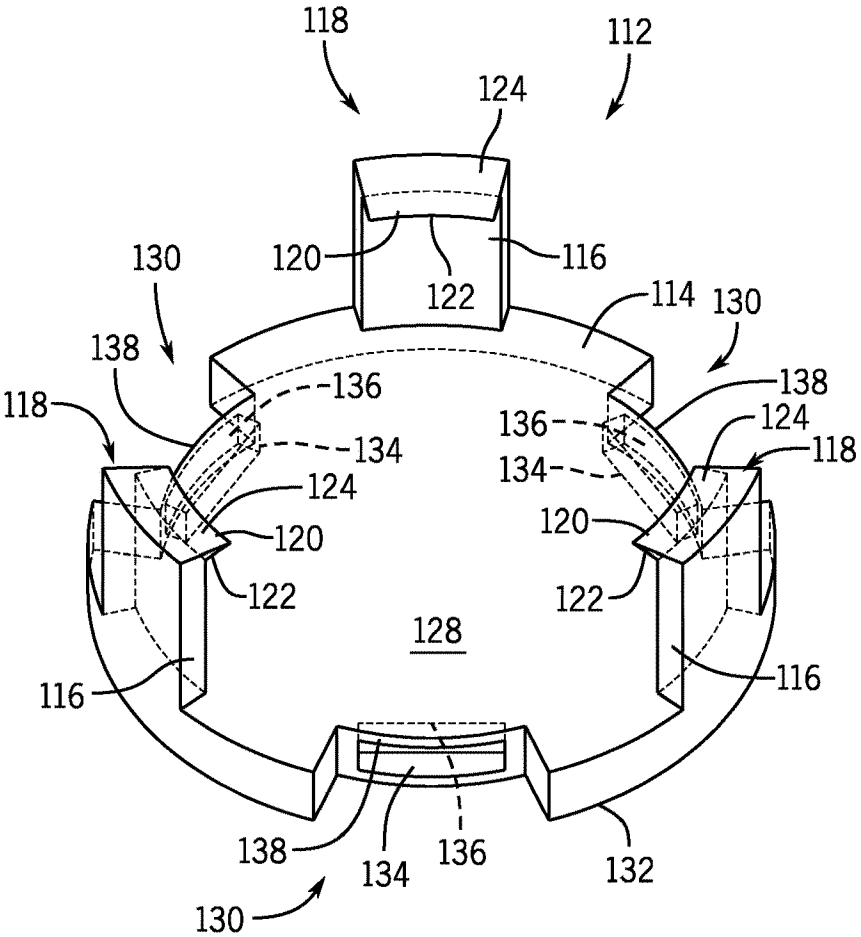
FIG. 3 is a top, front, side perspective view of a half section of an exemplary "teeth and cutouts" clasp assembly according to another embodiment. In this embodiment, each half section includes three protruding posts from a base having teeth on the distal ends thereof that are designed for engagement with three cutouts on the base of the mating half section.

FIGS. 3 and 4 illustrate views of another exemplary embodiment of a clasp assembly 110 and a half section 112 having a "teeth and cutouts" type design. Again, the clasp assembly 110 is designed to be affixed to a wristband, allowing the wristband to be formed into a secured loop around the wrist of the person wearing the wristband using the clasp assembly 110.

The clasp assembly 110 includes a pair of half sections 112 that, as illustrated in FIG. 4, are identical to one another. Each section can again be an integrally formed structure, for example, formed by plastic injection molding. By being formed from plastic, the parts may again be elastically deformable.

Each of the pair of half sections 112 includes a base 114, which as illustrated can be generally disc-shaped. However, the base 114 can be in various other forms or shapes. For example, the base 114 could be rectangular, square, triangular or other polygonal or non-polygonal shape. The shape of the base 114 may be altered in some cases or based on the shape of the wristband to which the clasp assembly 110 is to be attached.

The base 114 has a plurality of posts 116 extending from the base 114 in a generally axial direction relative to the disc that forms the base 114 and about the central axis of the base 114. As illustrated, three posts 116 are angularly arranged around the periphery of the base 114. However, it is contemplated that there could be two, three, or more posts on each base 114 and a similar operational effect could be achieved to that which is described herein.

Each of the posts 116 have a distal end 118 away from the base 114, which support and provide a tooth 120. Each tooth 120 has a wedge-like shape and radially projects inward towards the central axis from the respective post 116. As part of this projecting shape, each tooth 120 has a stop surface 122 facing back towards the base 114 from which the posts 116 extend. This stop surface 122 is generally parallel to the axial face of base 114 and/or is perpendicular to the central axis. Each tooth 120 also includes an inclined surface 124 on the axial end of the respective tooth 120 that extends downwardly as it extends radially inwards towards that central axis until it meets the stop surface 122 to establish the tip of the tooth 120. As illustrated, since both the stop surfaces 122 and the inclined surface 124 are planar, they come together at an acute angle.

Additionally, the base 114 has a plurality of cutouts 130 angularly spaced about the peripheral edge of the base 114. Each of the cutouts 130 is angularly spaced out from one another about the periphery and has an interposed post 116 between cutouts 130, such that as one travels around the periphery of the base 114 there is a post-cutout-post-cutout repeating pattern with a center of each feature being 60 degrees from the center of the next feature (as there are three of each feature for a total of six features). As illustrated, each of the cutouts 130 extends axially from a first axial surface 128 of the base 114 to a second axial surface 132 of the base 114 and extends radially inward from an otherwise circular periphery of the base 114. The cutout 130 as illustrated is generally arcuate-shaped, with a peripheral edge jutting inwards radially towards the center of the base 114.

In the form illustrated, each of the cutouts 130 further have a recess 134 that extends further radially inward from the periphery than the cutout 130. The recess 134 does not fully extend from the first axial surface 128 of the base 114 to the second axial surface 132 of the base 114, but only fractionally therebetween. Notably, there is at least some stop surface 136 created by this recess 134 that faces in a generally opposite axial direction from the stop surface 122 on the teeth 120 and which has a greater length than the tooth 120 of another identical half section 112 which will ultimately be received in the recess 134.

It should be appreciated that the positioning of the posts 116 with teeth 120 and the cutouts 130 with recesses 134 is such that, as will be illustrated in FIG. 4, the stop surfaces 122 of teeth 120 and the stop surfaces 136 of the recesses 134 will be engageable with one another. As such, there should be some rotational symmetry in the design of the half section 112 to permit this engagement and to do so at more than one angular position of the half sections 112 with respect to one another.

Looking now specifically at FIG. 4, FIG. 4 illustrates the clasp assembly 110 of FIG. 3 in an assembled state in which the pair of half sections 112 of the clasp assembly 110 are secured to one another. Specifically, to lock or engage the sections 112 together, the plurality of posts 116 of the pair of half sections 112 and the plurality of cutouts 130 with recesses 134 are axially brought together to engage the teeth 120 of the posts 116 with the recesses 134 of the cutouts 130 (and more specifically to engage the stop surfaces 122 of the teeth 120 on the posts 116 with the stop surfaces 136 of recesses 134 of the cutouts 130 so that cannot be axially withdrawn from one another). To assemble two identical half sections 112, the axial side of the half sections 112 having the posts 116 are made to face one another and the posts 116 of one of the half sections 112 are angularly aligned with the cutouts 130 on the other of the half sections 112. As the two half sections 112 are axially drawn together (as by the action of fastening the clasp on the wristband), the inclined surface 124 of the tooth 120 comes into contact with an edge 138 of the cutout 130 between the periphery and the first axial face 128, thereby effectuating the elastic deformation of the post 116 radially outward to permit the tooth 120 of the post 116 to axially pass by the edge 138 of the cutout 130. The stop surface 122 of the tooth 120 then continues to move axially until the stop surface 122 passes the corresponding stop surface 136 formed by the recess 134 in the cutout 130. The posts 116 then deflect back or return to a non-deformed state such that each of the teeth 120 of one half section 112 nests into the corresponding recesses 134 of the other half section 112, thereby creating an interlocking engagement between the posts 116 on one of the half sections 112 with the recesses 134 in the cutouts 130 on the other half sections 112 at the stop surfaces 122 and 136. This engagement cannot be readily separated in tension without breaking the teeth 120, posts 116, and/or a wall of the base 114 forming part of the recess 134. Accordingly, the clasp assembly 110 provides non-reversible, secure mechanism for one time-attachment.

While a particular geometry has been shown for "teeth and cutouts" type design, variations to the particular illustrated geometry are contemplated.

For example, while a particular shape and size of the posts 116 and teeth 120 have been shown along with those of the corresponding cutouts 130 and recesses 134, one of ordinary skill in the art will appreciate certain variations may be made while maintaining or even improving the functionality described below. For example, there could be slight undercuts on each of the stop surfaces 122 and 136 that could help to create interlocking engagement. Still further, while the arcuate length of the teeth 120 are roughly equal to the arcuate length of the recesses 134, the length of the teeth 120 could be appreciably less than the length of the recesses 134, creating a greater range of possible angular arrangements in which connection is possible. As another possibility, a regular polygonal shape may be employed such as a square or hexagon rather than a circle and that regular polygon may have alternating posts and recesses along each side or at each corner.

Still further, there could be different numbers of posts 116 and cutouts 130 than those illustrated. For example and as illustrated, each base 114 has three cutouts 130 that correspond to the three posts 116 and teeth 120. However, as it is contemplated that there could be two, three, or even more posts 116 on each base 114 with a corresponding number of cutouts 130 and a similar operational effect could be achieved to that which is described herein. As mentioned elsewhere in this disclosure, by maintaining some rotational symmetry in the design, it is possible to have multiple orientations of alignment. Still further, by increasing the number of features, it is possible to reduce the average amount of rotation in order to come into an aligned position in which the two halves may be joined.

Further, as illustrated, the number of the posts 116 and teeth 120 matches exactly the number of the cutouts 130 and recesses 134. However, this need not be the case. For instance, it is contemplated that there could be more recesses 134 than posts 116 with teeth 120. In such case, there could be various orientations of assembly between the two half sections 112 and some recesses may remain unoccupied even when the two half sections 112 are joined.

It is further considered that while, in the form presented, the recess 134 is generally rectangular-shaped or slightly arcuate-shaped to match the cutout 130 where the recess is located in, that other geometries could be used. For example, the recess 134 could be square, triangular or other polygonal or non-polygonal shape. In such case, the teeth on the posts may be designed to have similarly shaped mating geometries.

Even beyond this, it is contemplated that the half sections could be modified such that the posts are designed to deflect radially inward (relative it the center axis of the clasp) while the recesses are formed on a centrally-facing surface to effectively reverse the positioning of the mating features and their direction of deflection.

Figure 6:
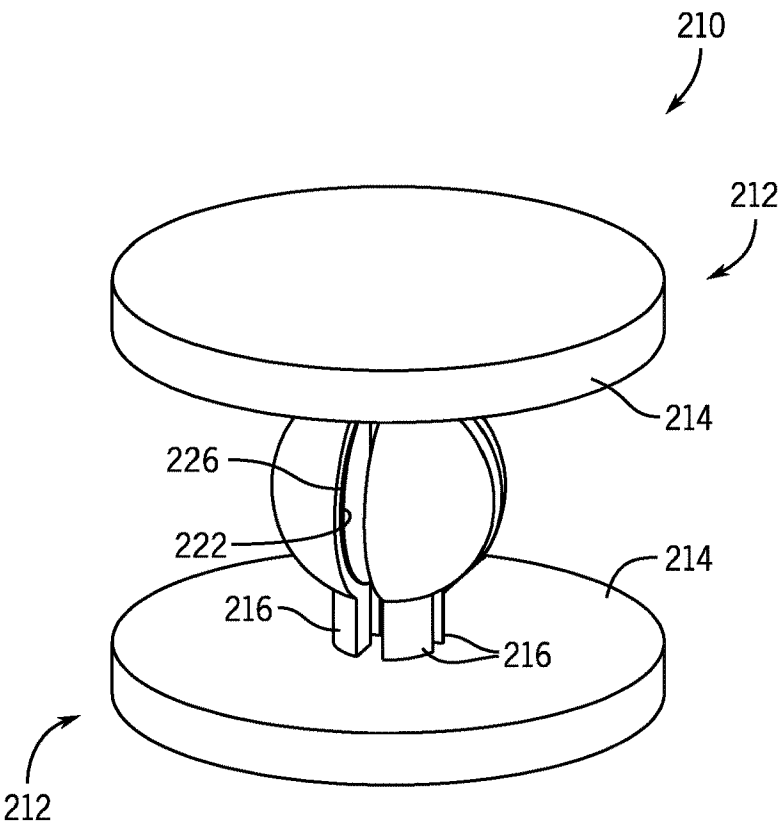
FIG. 6 is a perspective view of a clasp assembly assembled from a pair of identical half sections of the kind shown in FIGS. 5A and 5B in which the two half sections have been axially brought together to create an interlocking engagement between the axially-facing concave surfaces and the outwardly-facing convex surfaces.
Figure 5A:
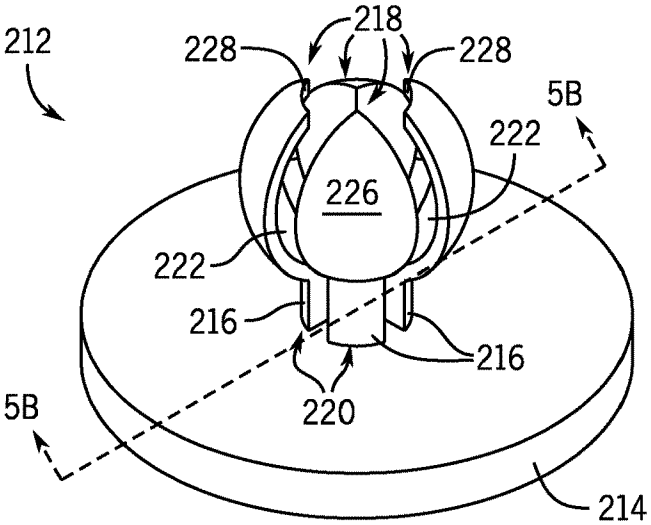
FIG. 5A is a top, front, side perspective view of a half section of an exemplary "cupped surfaces" clasp assembly according to still another embodiment. In this embodiment, each half section includes two posts having axially-facing concave surfaces and two posts having outwardly-facing convex surfaces.
Figure 5B:
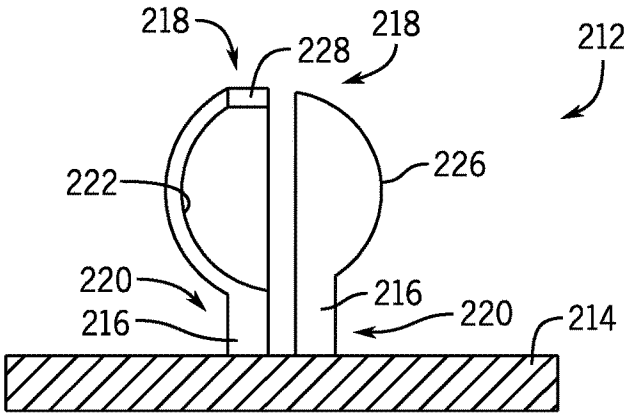
FIG. 5B is a cross sectional side view of the half section of FIG. 5A taken along line 5B-5B to better show the profile of the engagement surfaces of the half section.

Turning now to FIGS. 5A and 5B, these figures illustrate a half section 212 of a "cupped surfaces" style for a clasp assembly 210 can be assembled from two identical half sections 212 as illustrated in FIG. 6.

Again, the clasp assembly 210 includes a pair of half sections 212 that, as illustrated, are identical to one another. Each half section 212 can be an integrally formed unitary structure, for example, formed by plastic injection molding. By being formed from plastic, thin walls of the parts or other sections of them may be elastically deformable.

Each of the pair of half sections 212 includes a base 214, which as illustrated can be generally disc-shaped. However, the base 214 can be in various other forms or shapes. For example, the base 214 could be rectangular, square, triangular or other polygonal or non-polygonal shape. The shape of the base 214 may be altered in some cases, based on the shape of the wristband to which the clasp assembly 210 is attached.

The base 214 has a plurality of posts 216 extending from the base 214 in a generally axial direction relative to the disc that forms the illustrated base 214 and about the center of the base 214. As illustrated, there are four posts 216 on each base 214 arranged with their stems in a square on the base 214. However, it is contemplated that there could be two or more posts on each base 214 and a similar operational effect could be achieved to that which is described herein. Based on the nature of the mating arrangement for this embodiment, it would be contemplated that there would be an even number of posts 216 to provide the correct number of mating partners.

As illustrated, the posts 216 have alternating male and female features around the square that are shaped to engage with the posts 216 of another half section 212. On each half section 212, each of the posts 216 have a distal end 218 away from the base 214 and a proximal end 220 near the base 214. As illustrated, two of the posts 216 on opposing corners of the square have axially-facing concave surfaces 222 extending between their distal ends 218 and the proximal ends 220. The posts 216 with the axially-facing concave surface 222 together form female deformable features. Further, two of the posts 216 have outwardly-facing convex surfaces 226 extending between the distal end 218 and the proximal end 220 and are on the two other opposing corners of the square. The posts 216 with the outwardly-facing convex surface 226 together form male deformable features.

Looking now specifically at FIG. 6, FIG. 6 illustrates a clasp assembly 210 constructed from a pair of identical half sections 212 as illustrated in FIGS. 5A and 5B. Specifically, to temporarily lock or engage the half sections 212 together, the female deformable features (that is, the axially-facing concave surfaces 222) and male deformable features (that is, the outwardly-facing convex surface 226) of the pair of half sections 212 are axially brought together to simultaneously engage four pairs of outwardly-facing convex surfaces 226 with corresponding axially-facing concave surfaces 222. As they are brought together, the outwardly-facing convex surfaces 226 contact the axially-facing concave surfaces 222 of the posts and effectuate the temporary elastic deformation of the posts 216 at least one of inwardly and outwardly to permit the outwardly-facing convex surfaces 226 to pass by the distal ends 218 of the axially-facing concave surfaces 222. To permit this initial deflection, at the distal end of the female sections there may be a cutout 228 that permits entry of the leading distal edge of the slice of the male sections so that a "wedging" action may occur between the mating posts. This action continues until the outwardly-facing convex surfaces 226 reach or approach the proximal ends 220 of the axially-facing concave surface 222. As they reach the proximal ends 220, the posts 216 then return to a non-deformed state that creates an interlocking engagement between the posts 216 on one of the half sections 212 at the outwardly-facing convex surfaces 226 and the axially-facing concave surfaces 222 of the posts 216 on the other one of the half section 212 as illustrated in FIG. 6.

The interlocking engagement of the outwardly-facing convex surfaces 226 and the axially-facing concave surfaces 222 prevents the half sections 212 from readily separating absent the application of some threshold tensile force in the direction opposite the direction of insertion described above. Unlike the first two embodiments above, this connection between the two half sections 212 to form the clasp assembly 210 is reversible and the half sections 212 can be non-destructively separated.

The male and female mating features may have various geometric qualities. For one, in some forms and as illustrated, the curvatures or profiles of the axially-facing concave surfaces 222 and the outwardly-facing convex surfaces 226 may be the same. The axially-facing concave surfaces 222 and the outwardly-facing convex surfaces 226 may be generally frustospherical surfaces (in roughly quarter sections in the case of four posts). However, to better accommodate insertion, the profile may be slightly elongated to require less deflection of the posts 216 during insertion or withdrawal. Likewise, by virtue of both material selection and profile geometries, different threshold forces can be establish for assembly and disassembly.

Similarly, to alter the deflectional properties of the posts 216 and their attached mating components, the posts 216 and mating features may be made of different wall thickness or made solid. For example, as illustrated, the male sections are illustrated as solid wedges and the female sections are thin-walled such that the thin-walled sections are slightly more prone to deflection. Some of these geometries may also be made with respect to molding considerations and viability.

Typically, the number of female deformable features matches the number of male deformable features. However, it is contemplated that there could be more of one type of feature than the other (for example, more male features than female features or vice-versa) to permit various rotational engagements with one another. Still further, while four posts 216 are illustrated on each post, there could be more or fewer on each.

Still further, while the axially-facing concave surface 222 is illustrated as having a specific curvature and the outwardly-facing convex surface 226 is illustrated as having a specific curvature that closely matches, it should be appreciated that the curvatures of each of the types of posts could have different profiles, so long as the axially-facing concave surfaces 222 are capable of forming an interlocking engagement with the outwardly-facing convex surface 226.

Figure 8:
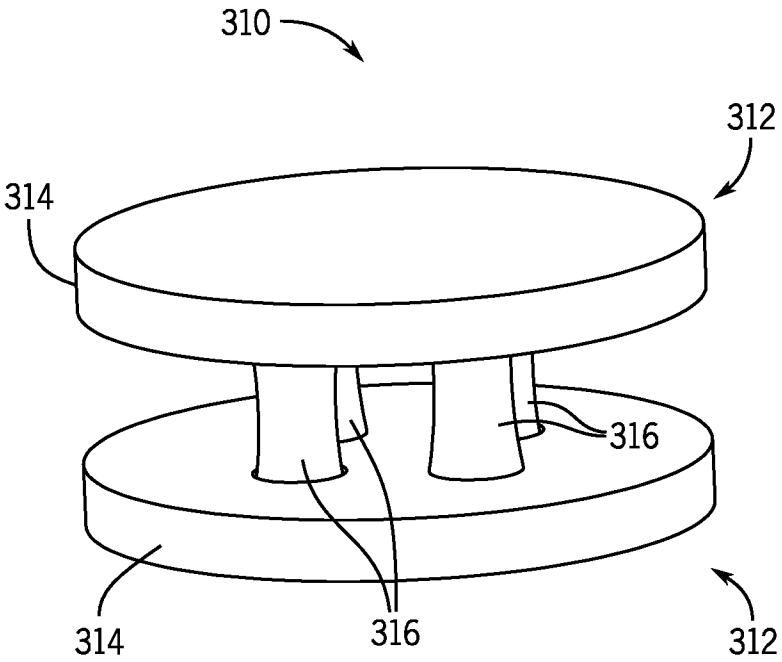
FIG. 8 is a perspective view of a clasp assembly assembled from a pair of identical half sections of the type shown in FIG. 7, in which the two half sections have been axially brought together to create an interlocking engagement between the ball-shaped surfaces and the socket depressions.
Figure 7:
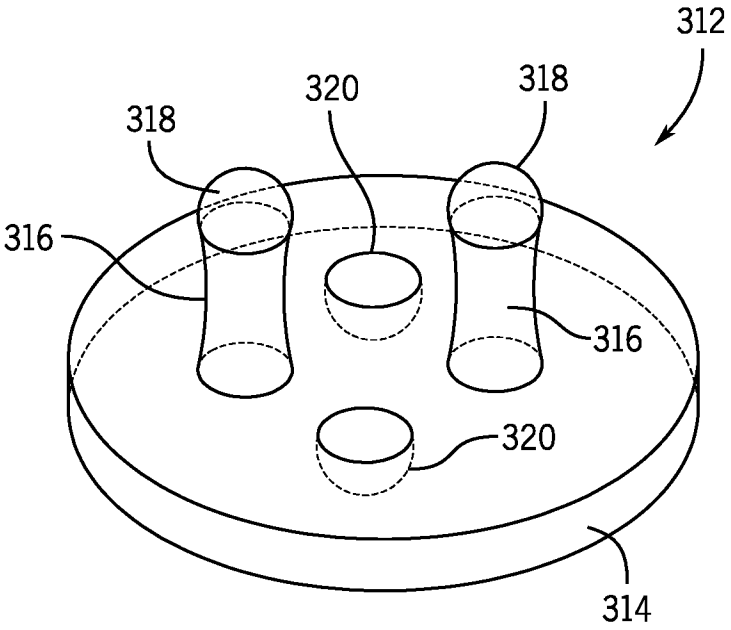
FIG. 7 is a top, front, side perspective view of a half section of an exemplary "ball and depression" clasp assembly according to yet another embodiment. In this embodiment, the half section includes two posts having ball-shaped surfaces on the distal ends of the posts protruding from a base and two socket depressions on the base in which the posts and the socket depressions are staged in an alternating fashion.

Turning now to FIGS. 7 and 8, FIG. 7 illustrates a half section 312 in which a pair of these half sections 312 can be assembled into an exemplary "ball and socket depression" type clasp assembly 310.

The clasp assembly 310 includes a pair of half sections 312 that, as illustrated, are identical to one another. Each section is an integrally formed structure, for example, formed by plastic injection molding. By being formed from plastic, the parts may be elastically deformable.

Each of the pair of half sections 312 includes a base 314, which as illustrated can be generally disc-shaped. However, the base 314 can be in various other forms or shapes in the various manners described above.

The base 314 has a plurality of posts 316 extending from the base 314 in a generally axial direction relative to the disc that forms the illustrated base 314 and about the center of the base 314. As illustrated, there are two posts 316 on each base 314; however, it is contemplated that there could be two or more posts 316 on each base 314 and a similar operational effect could be achieved to that which is described herein.

Each of the posts 316 have a generally ball-shaped surface 318 or head positioned away from the base 314. The generally ball-shaped surface 318 or head may have a radius and/or a curvature. As illustrated, the generally ball-shaped surface 318 is generally spherical; however, other shapes may be employed.

The base 314 also has a plurality of socket depressions 320 spaced about the center of the base 314. Each of the socket depressions 320 may have a radius and/or curvature that may be the same or slightly different from the radius and/or curvature of the generally ball-shaped surfaces 318. The socket depressions 320 as illustrated can be generally circular or spherical-shaped. However, the socket depressions 320 can be in various other forms or shapes and are contemplated as generally corresponding to the profile of the ball-shaped surfaces 318 of the posts 316. It is also contemplated that the shape of the socket need not exactly match the head of the post, but that they should correspond in form so as to permit the snap-type engagement with one another described below.

One or both of the ball-shaped surface 318 and the socket depressions 320 are able to deform slightly due to the elasticity of the plastic material to create individual interlocking engagement between one of the heads and a corresponding one of the sockets. Accordingly, the depressions 320 should be more than half of the volume of the hypothetical ball being inserted into it so that some amount of "capture" or interlocking occurs between the head or ball and socket.

Looking now at FIG. 8, FIG. 8 illustrates the clasp assembly 310 of FIG. 7 in an assembled state in which the pair of half sections 312 of the clasp assembly 310 are secured to one another. Specifically, to lock or engage the sections 312 together, the plurality of posts 316 with ball-shaped surfaces 318 and the socket depressions 320 of the pair of half sections 312 are axially brought together to engage the ball-shaped surfaces 318 or heads of the posts 316 with the socket depressions 320 on the base 314. During insertion, the ball-shaped surfaces 318 on one of the half sections 312 contact the socket depressions 320 on the base 314 of the other half section 312. This contact between the half sections 312 effectuates the elastic deformation of ball-shaped surfaces 318 and/or socket depressions 320 to temporarily and elastically crush ball-shaped surfaces 318 and/or expand the socket depression 320 to permit entry of the head into the socket. Upon sufficient insertion, the ball-shaped surfaces 318 "snap" into the socket depressions 320 and both return towards their original profiles. In the case of the illustrated embodiment, four such interlocking snap connections are made of this nature in near simultaneous fashion.

The interlocking engagement between the ball-shaped surfaces 318 and the socket depressions 320 prevents the half sections 312 from separating absent the application of a tensile force above a threshold force in the axial direction counter to the direction of insertion. Like the third embodiment, but unlike the first two embodiments, the heads can be removed from the sockets non-destructively and so the connection of the clasp assembly 310 is reversible.

Figure 9:
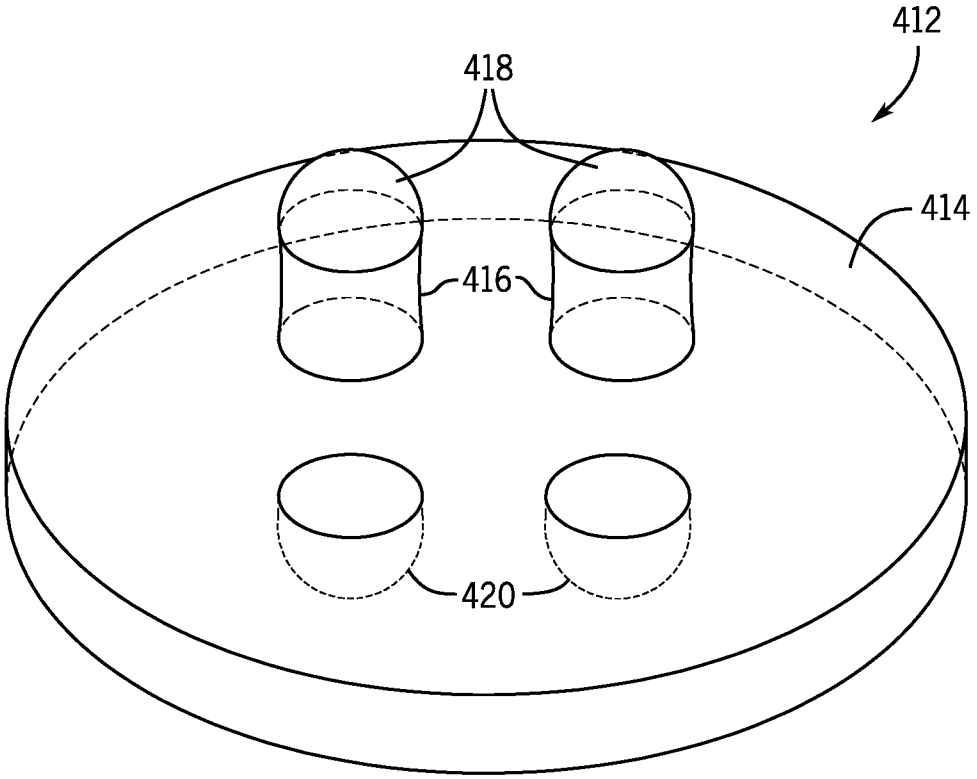
FIG. 9 is a top, front, side perspective view of a variation based on the half section of FIG. 7 for a "ball and depression" type clasp assembly according to yet still another embodiment. In this embodiment, the half section includes two posts having ball-shaped surfaces on the distal ends of the posts protruding from a base and two socket depressions on the base, in which the posts and the socket depressions are arranged at the corners of a square with the posts being at the corners on one half of the square and the socket depressions being at the corners on the other half of the square. Although not so illustrated, this embodiment can be assembled in a fashion similar to the one shown in FIG. 8.

As illustrated, there are two socket depressions 320 and two ball-shaped surfaces 320 on each base 314. However, it is contemplated that there could be two or more socket depressions 320 and two or more ball-shaped surfaces 318 on each base 314 and a similar operational effect could be achieved to that which is described herein. While illustrated as an alternating arrangement between the socket depressions 320 and the posts 316 with ball-shaped surfaces 318, the posts 316 with ball-shaped surfaces 318 and the socket depressions 320 may be arranged in other fashions. For example and in a non-limiting exemplary arrangement shown in FIG. 9 depicting an alternative half section 412, the posts 416 with ball-shaped surfaces 418 and the socket depressions 420 may be arranged at the corners of a square. In this form illustrated in FIG. 9, the posts 416 with ball-shaped surfaces 418 are at the corners on one-half of the square and the socket depressions 420 are at the corners on the other half of the square.

Generally speaking, discrete rotational symmetry is used in all of these embodiments to construct designs for each half section so that identical half sections can be used with one another. The half section is designed to couple with itself using symmetry constructs. The discrete rotational symmetry (360°/n), maximum rotation to close, and average rotation to close of 1 to 7 coupling mechanisms are shown in the table below:

TABLE 1

| Number of coupling mechanisms | Discrete rotational symmetry (360°/n) | Maximum rotation to close | Average rotation to close |
|---|---|---|---|
| 1 | n = 1, 360° | 360° | 180° |
| 2 | n = 2, 180° | 180° | 90° |
| 3 | n = 3, 120° | 120° | 60° |
| 4 | n = 4, 90° | 90° | 45° |
| 5 | n = 5, 72° | 72° | 36° |
| 6 | n = 6, 60° | 60° | 30° |
| 7 | n = 7, $51\frac{3}{7}$° | $51\frac{3}{7}$° | $25\frac{5}{7}$° |
| 360 | n = 360, 1° | 1° | 0.5° |

Rotational symmetry for an object of order n occurs when rotating the object by 360°/n does not change the object. Taking common joints and fractionalizing them or copying individual joints many times allows for the creation of clasps that both symmetrical and interlocking. In this way, the classic male/female designs for coupling can be obfuscated. The higher degrees of symmetry also benefit the closing of the clasps by requiring less rotation (maximum or average) to align the half sections for closure. Those skilled in the art of plastic injection molding and additive manufacturing techniques will understand that this complexity for small couplings can be extremely hard to engineer and that there are diminishing gains as n approaches 20 and beyond. Preferably, the discrete rotational symmetry of the half sections for the assembly disclosed are between 2 and 20, more preferably between 3 and 10 for the greatest combination of mechanical strength, manufacturing simplicity and usability.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A clasp assembly comprising:

a pair of identical half sections configured to be coupled together, in which each half section comprises one or more deformable features that are designed to deform during closure to create an interlocking engagement between each half section and in which the one or more deformable features are posts extending from a base of the respective half section, the posts having a wedge shape with a tooth at the distal end with the tooth having a stop surface facing the base;

wherein each of the pair of identical half sections has discrete rotational symmetry;

wherein, after interlocking engagement, the stop surface of a post on one half section contacts the stop surface of a post on the other half section such that the pair of identical half sections are not completely axially separable without permanent mechanical destruction of the one or more deformable features.

2. The clasp assembly of claim 1, wherein the posts extend axially from the base.

3. The clasp assembly of claim 2, wherein each tooth radially projects from the respective post.

4. The clasp assembly of claim 3, wherein the teeth further include tapered surfaces on angular ends thereof that narrow as the teeth extend towards the distal end of the respective post.

5. The clasp assembly of claim 4, wherein, when the posts of the pair of half sections are axially brought together to engage the teeth of the posts together, the tapered surfaces on angular ends of the posts on each of the half sections contact one another and effectuate the elastic deformation of the posts to permit the teeth of the posts to pass by one another until the stop surfaces of one of the half sections has axially passed the stop surfaces of the other one of the half sections, and the posts return to a non-deformed state which thereby creates an interlocking engagement between the posts on each of the half sections at the stop surfaces.

6. The clasp assembly of claim 4, wherein each of the stop surfaces have a corresponding angular extent between angular ends of the respective stop surface and wherein the total summed amount of the angular extents of the plurality of stop surfaces on one of the half sections exceeds 180 degrees to create angular overlap between the stop surfaces of the pair of half sections with one another when the posts of the half sections are brought together in interlocking engagement.

7. The clasp assembly of claim 1, wherein the pair of half sections are each an integrally formed plastic component.

8. A wristband comprising a band formable into a loop including the clasp assembly of claim 1.

9. A clasp assembly comprising:

a pair of identical half sections coupled together, in which each half section comprises one or more deformable features that are designed to deform during closure to create an interlocking engagement between each half section and in which the one or more deformable features are posts extending from a base of the respective half section, the posts having a wedge shape with a tooth at the distal end with the tooth having a stop surface facing the base;

wherein each of the pair of identical half sections has discrete rotational symmetry;

wherein the pair of identical half sections are assembled together and in interlocking engagement with the stop surface of a post on one half section contacting the stop surface of a post on the other half section such that the pair of identical half sections are not completely axially separable without permanent mechanical destruction of the one or more deformable features.

10. The clasp assembly of claim 9, wherein the posts extend axially from the base.

11. The clasp assembly of claim 10, wherein each tooth radially projects from the respective post.

12. The clasp assembly of claim 10, wherein each tooth further includes tapered surfaces on angular ends thereof that narrow as the tooth extends towards the distal end of the respective post.

13. The clasp assembly of claim 12, wherein, when the posts of the pair of half sections are axially brought together to engage the teeth of the posts together, the tapered surfaces on angular ends of the posts on each of the half sections contact one another and effectuate the elastic deformation of the posts to permit the teeth of the posts to pass by one another until the stop surfaces of one of the half sections has axially passed the stop surfaces of the other one of the half sections, and the posts return to a non-deformed state which thereby creates an interlocking engagement between the posts on each of the half sections at the stop surfaces.

14. The clasp assembly of claim 12, wherein each of the stop surfaces have a corresponding angular extent between angular ends of the respective stop surface and wherein the total summed amount of the angular extents of the plurality of stop surfaces on one of the half sections exceeds 180 degrees to create angular overlap between the stop surfaces of the pair of half sections with one another with the posts of the half sections in interlocking engagement.

15. The clasp assembly of claim 9, wherein the pair of half sections are each an integrally formed plastic component.

16. A wristband comprising a band formable into a loop including the clasp assembly of claim 9.

17. The clasp assembly of claim 4, wherein the tapered surfaces include a bevel near the distal end and an inclined section that runs from the end of the bevel to an axial position of the stop surface.

18. The clasp assembly of claim 12, wherein the tapered surfaces include a bevel near the distal end and an inclined section that runs from the end of the bevel to an axial position of the stop surface.

* * * * *